US006051530A

United States Patent [19]

Defieuw et al.

[11] Patent Number: 6,051,530

[45] Date of Patent: Apr. 18, 2000

[54] OUTERMOST LAYERS FOR USE IN THERMOGRAPHIC RECORDING MATERIALS

[75] Inventors: Geert Defieuw, Bonheiden; Rafaël Samijn, Wilrijk; Ivan Steels, Westerlo; Eddy Michiels, Duffel, all of Belgium

[73] Assignee: Agfa-Gevaert, Mortsel, Belgium

[21] Appl. No.: 09/216,226

[22] Filed: Dec. 18, 1998

Related U.S. Application Data

[60] Provisional application No. 60/072,677, Jan. 27, 1998.

[30] Foreign Application Priority Data

Dec. 18, 1997 [EP] European Pat. Off. ..... 97204013

[51] Int. Cl.[7] ..... B41M 5/40

[52] U.S. Cl. ..... 503/201; 427/150; 427/152; 503/200; 503/212; 503/226

[58] Field of Search ..... 427/150–152; 503/200, 201, 212, 226, 202

[56] References Cited

U.S. PATENT DOCUMENTS 4,396,684 8/1983 Morishita et al. ..... 428/537

5,380,693 1/1995 Goto ..... 503/200

FOREIGN PATENT DOCUMENTS 9512495 5/1995 WIPO .

*Primary Examiner*—Bruce H. Hess
*Attorney, Agent, or Firm*—Baker Botts L.L.P.

[57] ABSTRACT

A process for producing a thermographic recording material including on one side of a support, called the heat-sensitive side, a thermosensitive element, the outermost layer on the heat-sensitive side containing a cured polymer or cured polymer composition and silica, comprising the steps of: providing the heat-sensitive side of the support with an outermost layer by coating with a composition produced by mixing ingredients including colloidal silica, a curable polymer and a curing agent therefor; and drying and curing the outermost layer, wherein any acidic groups present in the colloidal silica upon acidification are substantially neutralized with ammonium ions, the curable polymer is a hydrophilic polymer having active hydrogen atoms and the curing agent is selected from the group consisting of polyisocyanates, aldehydes, titanates, zirconates, sulfone, boric acid and hydrolyzed tetraalkyl orthosilicate; and a method of recording an image therewith.

10 Claims, No Drawings

OUTERMOST LAYERS FOR USE IN THERMOGRAPHIC RECORDING MATERIALS

The application claims the benefit of the U.S. Provisional Application Ser. No. 60/072,677 filed Jan. 27, 1998.

FIELD OF THE INVENTION

The present invention relates to a thermographic recording material comprising a outermost layer suitable for use with thermal heads.

BACKGROUND OF THE INVENTION

Thermal imaging or thermography is a recording process wherein images are generated by the use of thermal energy. In thermography three approaches are known:

1. Direct thermal formation of a visible image pattern by image-wise heating of a recording material containing matter that by chemical or physical process changes colour or optical density.
2. Image-wise transfer of an ingredient necessary for the chemical or physical process bringing about changes in colour or optical density to a receptor element.
3. Thermal dye transfer printing wherein a visible image pattern is formed by transfer of a coloured species from an image-wise heated donor element onto a receptor element.

Direct thermal thermography is concerned with materials which are substantially not photosensitive, but are sensitive to heat or thermosensitive. Image-wise applied heat is sufficient to bring about a visible change in a thermosensitive imaging material. Most of the "direct" thermographic recording materials are of the chemical type. On heating to a certain conversion temperature, an irreversible chemical reaction takes place and a coloured image is produced. This irreversible reaction can be, for example, the reaction of a leucobase with an acid to produce the corresponding dye or the reduction of an organic or inorganic metal compound (e.g. silver, gold, copper or iron compounds) to its corresponding metal thereby producing a visible image. Such imaging materials are described, for example, in U.S. Pat. No. 3,080,254, EP-B 614 770, EP-B 614 769, EP-A 685 760, U.S. Pat. No. 5,527,757, EP-A 680 833, U.S. Pat. No. 5,536,696, EP-B 669 876, EP-A 692 391, U.S. Pat. No. 5,527,758, EP-A 692 733, U.S. Pat. No. 5,547,914, EP-A 730 196 and EP-A 704 318. A survey of "direct thermal" imaging methods is given e.g. in the book "Imaging Systems" by Kurt I. Jacobson-Ralph E. Jacobson, The Focal Press—London and New York (1976), Chapter VII under the heading "7.1 Thermography".

According to U.S. Pat. No. 3,080,254 a typical heat-sensitive copy paper includes in the heat-sensitive layer a thermoplastic binder, e.g. ethyl cellulose, a water-insoluble silver salt, e.g. silver stearate and an appropriate organic reducing agent, of which 4-methoxy-1-hydroxy-dihydronaphthalene is a representative. Localized heating of the sheet in the thermographic reproduction process, or for test purposes by momentary contact with a metal test bar heated to a suitable conversion temperature in the range of about 90–150° C., causes a visible change to occur in the heat-sensitive layer. The initially white or lightly coloured layer is darkened to a brownish appearance at the heated area. In order to obtain a more neutral colour tone a heterocyclic organic toning agent such as phthalazinone is added to the composition of the heat-sensitive layer. Thermosensitive copying paper is used in "front-printing" or "back-printing" using infra-red radiation absorbed and transformed into heat in contacting infra-red light absorbing image areas of an original as illustrated in FIGS. 1 and 2 of U.S. Pat. No. 3,074,809.

EP-B 726 852 discloses a recording material comprising on the same side of a support, called the heat-sensitive side, (1) one or more layers comprising an imaging composition essentially consisting of (i) a substantially light-insensitive organic silver salt being in thermal working relationship with (ii) a reducing agent, and (2) at the same side covering the imaging composition a protective layer, characterized in that the protective layer mainly comprises a cured polymer or cured polymer composition.

WO 94/16905 discloses a thermographic recording film comprising a support carrying: (a) an image-forming system; and (b) a protective layer comprising at least two epoxide moieties in the protective layer topcoat layer and/or in a layer on top of the protective topcoat layer, the ratio of colloidal silica to the compound containing at least two epoxide moieties being at least 2:1 by weight.

Thermographic recording materials with protective layers according to the teaching of EP-B 726 852 incorporating colloidal silica caused premature failure of thermal heads. O. P. Srivastava suggested at the 3rd Annual Printing Workshop held between Mar. 23 and 25, 1992 in Cambridge, Mass., USA, that sodium and/or potassium ions in thermographic materials form their hydroxides with water present in the atmosphere during thermal printing and that these hydroxides dissolve the protective glass coating of thermal printing heads and then migrate into the resistor material accelerating heating element failure. The inventor found that reduction of the sodium and potassium ion concentration to below 601 ppm as disclosed in U.S. Pat. No. 4,396,684 was of itself insufficient to ensure that a protective layer, in contact with a thermal head and covering an imaging layer, performed its function of protecting the imaging composition from damage and distortion without causing premature failure of thermal heads and in particular thin film thermal heads. There is therefore a need for thermographic recording materials with protective layers, in contact with a thermal head and covering an imaging layer thereof, which perform the function of protecting the imaging composition from damage and distortion without causing premature failure of thermal heads.

OBJECTS OF THE INVENTION

It is therefore an object of the present invention to provide a process for producing a thermographic recording material with a protective layer covering an imaging layer thereof, which has sufficient mechanical and thermal stability to protect the imaging composition and does not cause premature failure of thermal heads.

It is therefore a further object of the present invention to provide a method of recording an image by image-wise heating thermographic recording materials with protective layers in contact with a thermal head without causing premature failure of the thermal head.

Further objects and advantages of the invention will become apparent from the description hereinafter.

SUMMARY OF THE INVENTION

The objects of the present invention are realized by providing a process for producing a thermographic recording material including on one side of a support, called the heat-sensitive side, a thermosensitive element, the outermost layer on the heat-sensitive side containing a cured polymer or cured polymer composition and silica, comprising the steps of: providing the heat-sensitive side of the support with an outermost layer by coating with a composition produced by mixing ingredients including colloidal silica, a curable polymer and a curing agent therefor; and drying and curing the outermost layer, wherein any acidic groups present in the colloidal silica upon acidification are substantially neutralized with ammonium ions, the curable polymer is a hydrophilic polymer having active hydrogen atoms and the curing agent is selected from the group consisting of polyisocyanates, aldehydes, titanates, zirconates, sulfone, boric acid and hydrolyzed tetraalkyl orthosilicate. In a preferred embodiment of the present invention the thermographic recording material is substantially light-insensitive.

A method of recording an image is also provided by the present invention comprising the steps of: providing a thermographic recording material produced as described above, image-wise heating of the thermographic recording material by means of a thermal head contacting the heat-sensitive side of the thermographic recording material and removing the thermographic recording material from the thermal head.

Preferred embodiments of the present invention are disclosed in the detailed description of the invention.

DETAILED DESCRIPTION OF THE INVENTION

Surprisingly it has been found that thermographic recording materials having outermost layers according to the teaching of EP-B 726 852 with combined sodium and potassium ion concentrations of less than 601 ppm did not necessarily provide protection of the image-forming layers thereof. The replacement in such outermost layers of colloidal silica with any acid groups upon acidification having been substantially neutralized with sodium ions by colloidal silica with free acid groups produced thermographic recording materials which were severely distorted and physically damaged by a thermal head in contact therewith during image-wise heating. It has been surprisingly found that thermographic recording materials produced using colloidal silica in which any free acid groups produced upon acidification were substantially neutralized with ammonium ions were not damaged by a thermal head in contact therewith during image-wise heating.

Colloidal Silica with Acid Groups Substantially Neutralized with Ammonium Ions By the term colloidal silica is meant colloid-size particles of amorphous silica. Colloidal silica is usually used in the form of a silica sol, being an aqueous dispersion of colloidal silica. The term ammonium ions includes both substituted and unsubstituted ammonium ions. The term substituted ammonium ions includes substitution with alkyl and/or aryl groups and also heterocyclic ring systems with nitrogen atoms for example pyridinium, pyrimidinium and the like. Colloidal silica in which any acid groups are predominantly neutralized with unsubstituted ammonium ions is preferred according to the present invention. Colloidal silica with a specific surface area greater than 200 $m^2/g$ is preferred.

Buffer with a pH Between 2 and 7 Consisting of at Least One Acid and at Least One Non-metallic Salt In a preferred embodiment of the present invention the outermost layer of the thermographic recording material of the present invention further contains a buffer with a pH between 2 and 7 consisting of at least one acid and at least one non-metallic salt of an acid. Particularly preferred buffers for use in the thermographic recording materials of the present invention have a pH between 3 and 5.

Non-metallic salts include ammonium salts, the term ammonium salts including salts with both substituted and unsubstituted ammonium ions. The term substituted ammonium ions includes substitution with aryl and/or aryl groups and also heterocyclic ring systems with nitrogen atoms for example pyridinium, pyrimidinium and the like.

Preferred buffers with a pH between 2 and 7 consisting of at least one acid and at least one non-metallic salt of an acid consisting of a weak acid and a non-metallic salt are: phosphate/phosphoric acid buffers and carboxylate/carboxylic acid buffers. Particularly preferred buffers with a pH between 2 and 7 consisting of at least one acid and at least one non-metallic salt of an acid consisting of a weak acid and a non-metallic salt are: ammonium hydrogen phthalate/phthalic acid, ammonium dihydrogen phosphate/phosphoric acid, ammonium dihydrogen phosphate/citric acid, substituted ammonium acetate/acetic acid, ammonium acetate/acetic acid, ammonium succinate/succinic acid, ammonium hydrogen malaete/maleic acid etc. An especially preferred buffer according to the present invention is the ammonium acetate/acetic acid buffer.

Suitable buffers with a pH between 2 and 7 are:

BUF01: 30 g ammonium acetate and 150 mL acetic acid diluted to 1 L with deionized water with a pH of 3.90;

BUF02: 173.4 g acetic acid and 59.3 g 1,8-diazabicyclo [5.4.0]undec-7-ene (DBU) diluted to 1 L with deionized water and DBU added to attain a pH of 3.87;

BUF03: 173.4 g acetic acid and 58.2 g triethanolamine diluted to 1 L with deionized water with a pH of 3.95;

BUF04: 173.4 g acetic acid and 50.4 g diisopropylethylamine diluted to 1 L with deionized water and diisopropylethylamine added to attain a pH of 3.86;

BUF05: 173.4 g acetic acid and 39.5 g triethylamine diluted to 1 L with deionized water with a pH of 3.93;

BUF06: 173.4 g acetic acid and 47.3 g tris(hydroxymethyl) aminomethane diluted to 1 L with deionized water, with a pH of 3.88;

BUF07: 100 g ammonium acetate and 77 mL acetic acid diluted to 1 L with deionized water with a pH of 4.8;

BUF08: 300 g ammonium acetate and 22 mL acetic acid diluted to 1 L with deionized water with a pH of 5.8.

Outermost Layer on the Heat-sensitive Side of the Thermographic Recording Material According to the present invention the outermost layer on the heat-sensitive side of the thermographic recording material is produced using a composition containing colloidal silica in which any acid groups present upon acidification are substantially neutralized with ammonium ions, a polymer with active hydrogen atoms and a curing agent selected from the group consisting of polyisocyanates, aldehydes, titanates, zirconates, sulfone, boric acid and hydrolyzed tetraalkyl orthosilicate. Preferred curing agents are selected from the group consisting of formaldehyde, glyoxal, glutardialdehyde and hydrolyzed tetramethyl orthosilicate.

Suitable hydrophilic binders for use according to the present invention are: polyvinyl alcohol, copolymers of ethene and polyvinyl alcohol, gelatin, cellulose derivatives e.g. hydroxyethylcellulose, hydroxypropylcellulose etc. with polyvinyl alcohol being particularly preferred.

In general the outermost layer protects the thermosensitive element from atmospheric humidity and from surface damage by scratching etc. and prevents direct contact of printheads or heat sources with the image-forming layer in the thermosensitive element.

Outermost layers for thermosensitive elements which come into contact with and have to be transported past a heat source under pressure, have to exhibit resistance to local deformation and good slipping characteristics during transport past the heat source during heating.

The outermost layer, may further comprise a dissolved lubricating material and/or particulate material, e.g. talc particles, optionally protruding from the outermost layer. Examples of suitable lubricating materials are a surface active agent, a liquid lubricant, a solid lubricant or mixtures thereof, with or without a polymeric binder. The surface active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons and glycols. Examples of solid lubricants include various higher alcohols such as stearyl alcohol, fatty acids and fatty acid esters. Suitable lubricants for the outermost layer compositions are described, for example, in EP-A 138 483, EP-A 227 090, U.S. Pat. No. 4,567,113, U.S. Pat. No. 4,572,860, U.S. Pat. No. 4,717,711, EP-A 311 841, U.S. Pat. No. 5,587,350, U.S. Pat. No. 5,536,696, U.S. Pat. No. 5,547,914, WO 95/12495, EP-A 775 592 and EP-A 775 595.

Thermosensitive Element

According to the present invention, a thermographic recording material is provided including a thermosensitive element. Examples of suitable thermosensitive elements are: a leucobase with an acid in a binder, the corresponding dye being produced upon heating, and organic or inorganic metal compounds (e.g. silver, gold, copper or iron compounds) and a reducing agents therefor in a binder, the organic or inorganic metal compound being reduced to its corresponding metal upon heating. Preferred metal organic compounds for use with a reducing agent are organic silver salts.

The thermosensitive element may comprise a layer system in which the ingredients may be dispersed in different layers one of which is an image-forming layer, with the proviso that the active ingredients are in a thermal working relationship with one another i.e. during the thermal development process one active ingredient e.g. the reducing agent in the case of organic heavy metal salt/reducing agent systems, must be present in such a way that it is able to diffuse to the other active ingredient e.g. the substantially light-insensitive organic heavy metal salt particles in the case of organic heavy metal salt/reducing agent systems, so that the colour-forming process can take place. The thermosensitive element may be coated onto a support in sheet- or web-form from an organic solvent or from an aqueous medium.

Organic Silver Salts

Preferred substantially light-insensitive organic silver salts for use in the thermographic recording materials, according to the present invention, are silver salts of aliphatic carboxylic acids known as fatty acids, wherein the aliphatic carbon chain has preferably at least 12 C-atoms, e.g. silver laurate, silver palmitate, silver stearate, silver hydroxystearate, silver oleate and silver behenate, which silver salts are also called "silver soaps". Silver salts of modified aliphatic carboxylic acids with thioether group as described e.g. in GB-P 1,111,492 and other organic silver salts as described in GB-P 1,439,478, e.g. silver benzoate, may likewise be used to produce a thermally developable silver image. Combinations of different organic silver salts may also be used in the thermographic recording materials of the present invention.

A preferred process for producing a suspension of particles containing a substantially light-insensitive organic silver salt is disclosed in EP-A 754 969.

Organic Reducing Agents

Suitable organic reducing agents for the reduction of the substantially light-insensitive organic silver salts are organic compounds containing at least one active hydrogen atom linked to O, N or C, such as is the case with, aromatic di- and tri-hydroxy compounds; aminophenols; METOL™; p-phenylenediamines; alkoxynaphthols, e.g. 4-methoxy-1-naphthol described in U.S. Pat. No. 3,094,41; pyrazolidin-3-one type reducing agents, e.g. PHENIDONE™; pyrazolin-5-ones; indan-1,3-dione derivatives; hydroxytetrone acids; hydroxytetronimides; hydroxylamine derivatives such as for example described in U.S. Pat. No. 4,082,901; hydrazine derivatives; and reductones e.g. ascorbic acid; see also U.S. Pat. Nos. 3,074,809, 3,080,254, 3,094,417 and 3,887,378.

Among the catechol-type reducing agents, i.e. reducing agents containing at least one benzene nucleus with two hydroxy groups (—OH) in ortho-position, the following are preferred: catechol, 3-(3,4-dihydroxyphenyl) propionic acid, 1,2-dihydroxybenzoic acid, gallic acid and esters e.g. methyl gallate, ethyl gallate, propyl gallate, tannic acid, and 3,4-dihydroxy-benzoic acid esters. Particularly preferred catechol-type reducing agents, described in EP-A 692 733, are benzene compounds in which the benzene nucleus is substituted by no more than two hydroxy groups which are present in 3,4-position on the nucleus and have in the 1-position of the nucleus a substituent linked to the nucleus by means of a carbonyl group.

The silver image density depends on the coverage of the above defined reducing agent(s) and organic silver salt(s) and has to be preferably such that, on heating above 100° C., an optical density of at least 2.5 can be obtained. Preferably at least 0.10 moles of reducing agent per mole of organic silver salt is used.

Auxiliary Reducing Agents

The reducing agents used in accordance with the present invention being considered as primary or main reducing agents may be used in conjunction with so-called auxiliary reducing agents. Such auxiliary reducing agents are e.g. hydroquinone or catechol substituted with strongly electron-withdrawing groups such as sulfonic acid groups; sterically hindered phenols, such as described in U.S. Pat. No. 4,001,026; bisphenols, e.g. of the type described in U.S. Pat. No. 3,547,648; sulfonamidophenols, such as described in Research Disclosure, February 1979, item 17842, in U.S. Pat. No. 4,360,581 and 4,782,004, and in EP-A 423 891; hydrazides such as disclosed in EP-A 762 196, sulfonyl hydrazide reducing agents such as disclosed in U.S. Pat. No. 5,464,738; trityl hydrazides and formyl-phenyl-hydrazides such as disclosed in U.S. Pat. No. 5,496,695; trityl hydrazides and formyl-phenyl-hydrazides with diverse auxiliary reducing agents such as disclosed in U.S. Pat. No. 5,545,505, U.S. Pat. No. 5.545.507 and U.S. Pat. No. 5,558,983; acrylonitrile compounds as disclosed in U.S. Pat. No. 5,545,515 and U.S. Pat. No. 5,635,339; 2-substituted malondialdehyde compounds such as disclosed in U.S. Pat.

No. 5,654,130; and organic reducing metal salts, e.g. stannous stearate described in U.S. Pat. Nos. 3,460,946 and 3,547,648. The auxiliary reducing agents may be present in the imaging layer or in a polymeric binder layer in thermal working relationship thereto.

In a preferred embodiment of the present invention the thermographic recording material comprises a support and a thermosensitive element which further contains a catechol compound substituted with a strongly electron-withdrawing group.

Binders for the Thermosensitive Element

The thermosensitive element of the thermographic recording materials produced according to the present invention may be coated onto a support in sheet- or web-form from an organic solvent containing the binder dissolved therein or may be applied from an aqueous medium using water-soluble or water-dispersible binders.

Suitable binders for coating from an organic solvent are all kinds of natural, modified natural or synthetic resins or mixtures of such resins, wherein the organic heavy metal salt can be dispersed homogeneously: e.g. cellulose derivatives, cellulose esters, carboxymethylcellulose, starch ethers, galactomannan, polyurethanes, polycarbonates, polyesters, polymers derived from α,β-ethylenically unsaturated compounds such as after-chlorinated polyvinyl chloride, partially hydrolyzed polyvinyl acetate, polyvinyl alcohol, polyvinyl acetals, preferably polyvinyl butyral, and homopolymers and copolymers produced using monomers selected from the group consisting of: vinyl chloride, vinylidene chloride, vinyl esters, acrylonitrile, acrylamides, methacrylamides. methacrylates, acrylates, methacrylic acid, acrylic acid, vinyl esters, styrenes, dienes and alkenes; or mixtures thereof.

Suitable water-soluble film-forming binders are: polyvinyl alcohol, polyacrylamide, polymethacrylamide, polyacrylic acid, polymethacrylic acid, polyethyleneglycol, polyvinylpyrrolidone, proteinaceous binders such as gelatine modified gelatines such as phthaloyl gelatine, polysaccharides, such as starch, gum arabic and dextran and water-soluble cellulose derivatives.

Suitable water-dispersible binders are any water-insoluble polymer e.g. water-insoluble cellulose derivatives, polyurethanes, polycarbonates, polyesters and polymers derived from α,β-ethylenically unsaturated compounds such as after-chlorinated polyvinyl chloride, partially hydrolyzed polyvinyl acetate, polyvinyl alcohol, polyvinyl acetals, preferably polyvinyl butyral, and homopolymers and copolymers produced using monomers selected from the group consisting of: vinyl chloride, vinylidene chloride, acrylonitrile, acrylamides, methacrylamides. methacrylates, acrylates, methacrylic acid, acrylic acid, vinyl esters, styrenes, dienes and alkenes; or mixtures thereof. It should be noted that there is no clear cut transition between a polymer dispersion and a polymer solution in the case of very small polymer particles resulting in the smallest particles of the polymer being dissolved and those slightly larger being in dispersion.

Preferred water-dispersible binders for use according to the present invention are water-dispersible film-forming polymers with covalently bonded ionic groups selected from the group consisting of sulfonate, sulfinate, carboxylate, phosphate, quaternary ammonium, tertiary sulfonium and quaternary phosphonium groups. Further preferred water-dispersible binders for use according the present invention are water-dispersible film-forming polymers with covalently bonded moieties with one or more acid groups.

Water-dispersible binders with crosslinkable groups, e.g. epoxy groups, aceto-acetoxy groups and crosslinkable double bonds are also preferred.

The binder to organic silver salt weight ratio is preferably in the range of 0.2 to 6, and the thickness of the recording layer is preferably in the range of 1 to 50 μm.

Thermal Solvents

The above mentioned binders or mixtures thereof may be used in conjunction with waxes or "heat solvents" also called "thermal solvents" or "thermosolvents" improving the reaction speed of the redox-reaction at elevated temperature. By the term "heat solvent" in this invention is meant a non-hydrolyzable organic material which is in a solid state in the recording layer at temperatures below 50° C., but becomes a plasticizer for the recording layer where thermally heated and/or a liquid solvent for at least one of the redox-reactants.

Toning Agents

In order to obtain a neutral black image tone in the higher densities and neutral grey in the lower densities, thermographic recording materials produced according to the present invention may contain one or more toning agents. The toning agents should be in thermal working relationship with the substantially light-insensitive organic silver salt and reducing agents during thermal processing. Any known toning agent from thermography or photothermography may be used.

Suitable toning agents are the phthalimides and phthalazinones within the scope of the general formulae described in U.S. Pat. No. 4,082,901 and the toning agents described in U.S. Pat. No. 3,074,809, U.S. Pat. No. 3,446,648 and U.S. Pat. No. 3,844,797. Particularly useful toning agents are the heterocyclic toner compounds of the benzoxazine dione or naphthoxazine dione type described in GB-P 1,439,478, U.S. Pat. No. 3,951,660 and U.S. Pat. No. 5,599,647.

Polycarboxylic acids and anhydrides thereof According to a preferred embodiment of the thermographic recording material produced according to the present invention, the thermosensitive element further contains at least one polycarboxylic acid and/or anhydride thereof in a molar percentage of at least 20 with respect to the substantially light-insensitive organic silver salt and in thermal working relationship therewith. The polycarboxylic acid may be aliphatic (saturated as well as unsaturated aliphatic and also cycloaliphatic) as disclosed in U.S. Pat. No. 5,527,758 or an aromatic polycarboxylic acid, may be substituted and may be used in anhydride form or partially esterified on the condition that at least two free carboxylic acids remain or are available in the heat recording step.

Stabilizers and Antifoggants

In order to obtain improved shelf-life and reduced fogging, stabilizers and antifoggants may be incorporated into the thermographic recording materials produced according to the present invention. Examples of suitable stabilizers and antifoggants and their precursors, which can be used alone or in combination, include the thiazolium salts described in U.S. Pat. Nos. 2,131,038 and 2,694,716; the azaindenes described in U.S. Pat. Nos. 2,886,437 and 2,444,605; the urazoles described in U.S. Pat. No. 3,287,135; the sulfocatechols described in U.S. Pat. No. 3,235,652; the oximes described in GB-P 623,448; the thiuronium salts described in U.S. Pat. No. 3,220,839; the palladium, platinum and gold salts described in U.S. Pat. No. 2,566,263 and 2,597,915; the tetrazolyl-thio-compounds described in U.S. Pat. No. 3,700,457 for example 1-(3'-n-nonylamido-oxophenyl)-1H-tetrazole-5-thiol; the mesoionic 1,2,4-triazolium-3-thiolate stablizer precursors described in U.S. Pat. Nos. 4,404,390 and 4,351,896; the tribromomethyl ketone compounds described in EP-A 600 587; the combination of isocyanate and halogenated compounds described in EP-A 600 586; the vinyl sulfone and β-halo sulfone compounds described in EP-A 600 589; and those compounds mentioned in this context in Chapter 9 of "Imaging Processes and Materials, Neblette's 8th edition", by D. Kloosterboer, edited by J. Sturge, V. Walworth and A. Shepp, page 279, Van Nostrand (1989); in Research Disclosure 17029 published in June 1978; and in the references cited in all these documents.

Surfactants and Dispersants

Surfactants and dispersants aid the dispersion of ingredients which are insoluble in the particular dispersion medium. The thermographic recording materials produced according to the present invention may contain one or more surfactants, which may be anionic, non-ionic or cationic surfactants and/or one or more dispersants.

Suitable dispersants are natural polymeric substances, synthetic polymeric substances and finely divided powders, for example finely divided non-metallic inorganic powders such as silica. Suitable hydrophilic natural or synthetic polymeric substances contain one or more hydroxyl, carboxyl or phosphate groups, e.g. protein-type binders such as gelatin, casein, collagen, albumin and modified gelatin ; modified cellulose; starch; modified starch; modified sugars; modified dextrans etc. Examples of suitable hydrophilic synthetic polymeric substances are polyacetals, such as polyvinylbutyral; polyvinylalcohol; polyvinylpyrrolidone; polyacrylic acid; and polymethacrylic acid and their copolymers and salts thereof.

Other Ingredients

In addition to the above-mentioned ingredients the thermographic recording material produced according to the present invention may contain other additives such as free fatty acids, antistatic agents, e.g. non-ionic antistatic agents including a fluorocarbon group as e.g. in $F_3C(CF_2)_6CONH(CH_2CH_2O)$—H, silicone oil, e.g. BAYSILON™ Öl A (BAYER AG, GERMANY), ultraviolet light absorbing compounds, white light reflecting and/or ultraviolet radiation reflecting pigments, silica, and/or optical brightening agents.

Support

The support for the thermographic recording material produced according to the present invention may be transparent, translucent or opaque and is preferably a thin flexible carrier made e.g. from paper, polyethylene coated paper or transparent resin film, e.g. made of a cellulose ester, e.g. cellulose triacetate, polypropylene, polycarbonate or polyester, e.g. polyethylene terephthalate. The support may be in sheet, ribbon or web form and subbed if needs be to improve the adherence to the thereon coated heat-sensitive recording layer. The support may be made of an opacified resin composition, e.g. polyethylene terephthalate opacified by means of pigments and/or micro-voids, and/or may be coated with an opaque pigment-binder layer, and may be called synthetic paper, or paperlike film. Information about such supports can be found in EP's 194 106 and 234 563 and U.S. Pat. Nos. 3,944,699, 4,187,113, 4,780,402 and 5,059,579.

Coating Techniques

The coating of any layer of the thermographic recording materials produced according to the present invention may proceed by any coating technique e.g. such as described in Modern Coating and Drying Technology, edited by Edward D. Cohen and Edgar B. Gutoff, (1992) VCH Publishers Inc. 220 East 23rd Street, Suite 909 New York, N.Y. 10010, U.S.A. Coating may proceed from aqueous or solvent media with overcoating of dried, partially dried or undried layers.

Thermographic Printing

Thermographic imaging is carried out by the image-wise application of heat either in analogue fashion by direct exposure through an image of by reflection from an image, or in digital fashion pixel by pixel either by using an infra-red heat source, for example with a Nd-YAG laser or other infra-red laser, or by direct thermal imaging with a thermal head.

In thermal printing image signals are converted into electric pulses and then through a driver circuit selectively transferred to a thermal printhead. The thermal printhead consists of microscopic heat resistor elements, which convert the electrical energy into heat via Joule effect. The electric pulses thus converted into thermal signals manifest themselves as heat transferred to the surface of the thermal paper wherein the chemical reaction resulting in colour development takes place. Such thermal printing heads may be used in contact or close proximity with the recording layer. The operating temperature of common thermal printheads is in the range of 300 to 400° C. and the heating time per picture element (pixel) may be less than 1.0 ms, the pressure contact of the thermal printhead with the recording material being e.g. 200–500 g/cm$^2$ to ensure a good transfer of heat.

The image signals for modulating the laser beam or current in the micro-resistors of a thermal printhead are obtained directly e.g. from opto-electronic scanning devices or from an intermediary storage means, e.g. magnetic disc or tape or optical disc storage medium, optionally linked to a digital image work station wherein the image information can be processed to satisfy particular needs.

Activation of the heating elements can be power-modulated or pulse-length modulated at constant power. The image-wise heating can be carried out such that heating elements not required to produce an image pixel generate an amount of heat (He) in accordance with the following formula:

$$0.5\ H_D<H_e<H_D$$

wherein $H_D$ represents the minimum amount of heat required to cause visible image formation in the thermographic material. EP-A 654 355 describes a method for making an image by image-wise heating by means of a thermal head having energizable heating elements, wherein the activation of the heating elements is executed duty cycled pulsewise. When used in thermographic recording operating with thermal printheads the thermographic recording materials are not suitable for reproducing images with fairly large number of grey levels as is required for continuous tone reproduction. EP-A 622 217 discloses a method for making an image using a direct thermal imaging element producing improvements in continuous tone reproduction.

Image-wise heating of the thermographic recording material can also be carried out using an electrically resistive ribbon incorporated into the material. Image- or pattern-wise heating of the thermographic recording material may also proceed by means of pixel-wise modulated ultra-sound, using e.g. an ultrasonic pixel printer as described e.g. in U.S. Pat. No. 4,908,631.

Industrial Application

Thermographic recording materials produced according to the present invention may be used for both the production of transparencies, for example in the medical diagnostic field in which black-imaged transparencies are widely used in inspection techniques operating with a light box, and reflection type prints, for example in the hard copy field. For such applications the support will be transparent or opaque, i.e. having a white light reflecting aspect. Should a transparent base be used, the base may be colourless or coloured, e.g. with a blue colour for medical diagnostic applications.

The following INVENTION EXAMPLES and COMPARATIVE EXAMPLES illustrate the present invention. The percentages and ratios used in the examples are by weight unless otherwise indicated.

EXAMPLES

The following ingredients were used in the thermosensitive element of the examples in addition to those mentioned above:

| | |
|---|---|
| AgBeh | = silver behenate; |
| B79 | = Butvar ™ B79, a polyvinyl butyral from MONSANTO; |
| R01 | = ethyl 3,4-dihydroxybenzoate; |
| S01 | = adipic acid; |
| S02 | = tetrachlorophthalic anhydride |
| S03 | = benzotriazole |
| T01 | = benzo[e] [1,3]oxazine-2,4-dione; |
| T02 | = 7-(ethylcarbonato)benzo[e] [1,3]oxazine-2,4-dione; |
| Baysilon ™ MA | = a silicone oil, from BAYER AG; |

and the following ingredients were used in the outermost layer thereof:

| | |
|---|---|
| Polyviol ™ WX 48 20 | = a polyvinylalcohol, from Wacker Chemie; |
| purified polyvinyl alcohol | = Polyviol ™ WX 48 20 purified by extraction with methanol/water (75/25 by volume); |
| dispersant 01 | = Ultravon ™ W, a dispersion agent from Ciba Geigy, converted into acid form by passing through an ion exchange column; |
| dispersant 02 | = Hostapal B, a dispersion agent converted into acid form by passing through an ion exchange resin; |
| Syloid ™ 72 | = a porous silica, from Grace; |
| Nippon Talc type P3 | = an Indian talc from Nippon Talc; |
| Steamic ™OOS | = a talc, from Talc de Luzenac; |
| Servoxyl ™ VPAZ 100 | = a mixture of monolauryl and dilauryl phosphate, from Servo Delden B.V.; |
| Servoxyl ™ VPDZ 3/100 | = a mono[isotridecyl polyglycolether (3 EO)] phosphate, from Servo Delden B.V.; |
| Rilanit ™ GMS | = a glycerine monotallow acid ester, from Henkel AG; |
| Levasil ™ VP AC 4055 | = a 15% aqueous dispersion of colloidal silica with acid groups substantially neutralized with sodium ions and a specific surface area of 500 $m^2/g$, from Bayer AG. |

INVENTION EXAMPLE 1

Preparation of colloidal silica with any acid groups upon acidification substantially neutralized with ammonium ions Colloidal silica with any acid groups upon acidification substantially neutralized with ammonium ions was prepared from Levasil™ VP AC 4055 in a two step process. In the first step 10 L of the acidic ion exchange resin LEWATIT™ S100MB was added to a mixture of 12 L of deionized water and 4 L of a 26% aqueous ammonia solution. The dispersion was then stirred for 90 minutes thereby converting the ion exchange resin into its ammonium form. The converted ion exchange resin in the ammonium form was then filtered off and washed with deionized water until the washwater was neutral. In the second step 5 L of the ion exchange resin in the ammonium form was added to 20 L of Levasil™ VP AC 4055 and the resulting dispersion stirred for 2 hours. The ion exchange resin was then filtered off, a further 5 L of the ion exchange resin in the ammonium form added, the dispersion stirred for 2 hours and then the ion exchange resin was filtered off. This process reduced the concentration of sodium ions in the 15% aqueous dispersion of colloidal silica from ca. 3000 ppm to ca. 150 ppm (i.e. 1000 ppm sodium in solid colloidal silica).

COMPARATIVE EXAMPLE 1

Colloidal silica with free acid groups was prepared in an analogous way to the colloidal silica with acid groups predominantly neutralized with ammonia ions as described in INVENTION EXAMPLE 1 except that the first step was omitted and the second step carried out with LEWATIT™ S100MB in the acid form instead of LEWATIT™ S100MB in the ammonium form.

COMPARATIVE EXAMPLE 2

Thermosensitive Element

A subbed polyethylene terephthalate support having a thickness of 175 $\mu$m was coated with a coating composition containing 2-butanone as a solvent and the following ingredients so as to obtain thereon, after drying for 1 hour at 50° C., a layer containing:

| | |
|---|---|
| AgBeh: | 4.91 $g/m^2$ |
| B79: | 19.62 $g/m^2$ |
| Baysilon ™ MA | 0.045 $g/m^2$ |
| T01, a toning agent: | 0.268 $g/m^2$ |
| T02, a toning agent: | 0.138 $g/m^2$ |
| R01, a reducing agent: | 0.92 $g/m^2$ |
| S01: | 0.352 $g/m^2$ |
| S02: | 0.157 $g/m^2$ |
| S03: | 0.130 $g/m^2$ |

Coating of the thermosensitive element with a outermost layer

An aqueous dispersion was then prepared with the composition given below:

| | |
|---|---|
| Polyviol ™ WX 48 20: | 2.5% |
| dispersant 01: | 0.09% |
| Nippon Talc type P3: | 0.05% |
| Syloid ™ 72: | 0.10% |
| Servoxyl ™ VPDZ 3/100: | 0.09% |
| Servoxyl ™ VPAZ 100: | 0.09% |
| Rilanit ™ GMS: | 0.18% |

-continued

| | |
|---|---|
| tetramethylorthosilicate hydrolyzed in the presence of methanesulfonic acid: | 2.1% |
| Levasil ™ VP AC 4055, a colloidal silica with acid groups predominantly neutralized with sodium ions: | 1.2% |

Those ingredients which were insoluble in water, were dispersed in a ball mill with, if necessary, the aid of a dispersion agent.

Before coating the pH of the composition was adjusted to a pH of 3.8 by adding 1N nitric acid. The thermosensitive element was coated with this dispersion to a wet layer thickness of 85 $\mu$m and the layer dried at 40° C. for 15 minutes and then hardened at 45° C. for 7 days.

Printing

Printing was carried out with a printer in which a thin film thermal printing head had been installed. Sheets of the above-mentioned substantially non-photosensitive thermographic recording material were fed at a speed of 4 mm/s onto a drum past the thermal printing head mounted in such a way as to contact the substantially non-photosensitive thermographic recording material. The thermal printing head was operated at a line time of 19 ms (the line time being the time needed for printing one line), during which it received constant power, and at an average printing power, being the total amount of electrical energy used for printing one line divided by the line time and the surface area of the heat-generating resistors, of 1.25 mJ/dot, being sufficient to obtain maximum density in the recording material. A defective heating element, corresponding in position to a pinhole in the outermost layer of the thermal printing head was detected in the prints as a white line after 50 prints.

COMPARATIVE EXAMPLE 3 and INVENTION EXAMPLES 2 & 3

The thermosensitive element of COMPARATIVE EXAMPLE 3 and INVENTION EXAMPLES 2 & 3 were as described for COMPARATIVE EXAMPLE 2. The outermost layers of COMPARATIVE EXAMPLE 3 and INVENTION EXAMPLES 2 & 3 coated onto the thermosensitive element were as described for COMPARATIVE EXAMPLE 2 except that: the talc used was Steamic™OOS from Talc de Luzenac instead of type P3 from Nippon Talc, purified polyvinyl alcohol was used instead of Polyviol™ WX 48 20, dispersant 02 was used in INVENTION EXAMPLE 2 instead of dispersant 01 and the Levasil™ VP AC 4055 both in type and amount was replaced by the type of colloidal silica in the amount given in table 1 below.

Thermographic Printing

The printer was equipped with a thin film thermal head with a resolution of 300 dpi and was operated with a line time of 19 ms (the line time being the time needed for printing one line). During this line time the print head received constant power. The average printing power, being the total amount of electrical input energy during one line time divided by the line time and by the surface area of the heat-generating resistors was 1.6 mJ/dot being sufficient to obtain maximum optical density in each of the thermographic recording materials of COMPARATIVE EXAMPLE 3 and INVENTION EXAMPLES 2 & 3. The linear pressure between the thermal head and the thermographic recording material during printing was 300g wt./cm.

The damage sustained by the outermost layers of COMPARATIVE EXAMPLE 3 and INVENTION EXAMPLES 2 & 3 in the printer during printing is given in table 1 below:

TABLE 1

| Example number | Colloidal silica Type | Colloidal silica prepared in | conc. in coating dispersion | Dispersant | Transport in printer | Surface damage |
|---|---|---|---|---|---|---|
| Comparative 3 | acidic | comparative example 1 | 1.2% | 01 | poor | substantial |
| Invention 2 | ammonium | invention example 1 | 1.2% | 01 | excellent | negligible |
| Invention 3 | ammonium | invention example 1 | 1.2% | 02 | good | slight |

Sheets of the thermographic recording materials of INVENTION EXAMPLES 2 and 3 were fed at a speed of 4 mm/s onto a drum past the thermal printing head mounted in such a way as to contact the substantially non-photosensitive thermographic recording material using a thermal head with a pinhole in its outermost layer. 100 sheets were printed without a defective heating element being detected although a pinhole in the outermost layer of the printhead was visible, thereby demonstrating a considerable improvement in the printing performance of the thermographic recording materials of INVENTION EXAMPLES 2 & 3 over that of COMPARATIVE EXAMPLE 2.

INVENTION EXAMPLE 4

The thermographic recording material of INVENTION EXAMPLE 4 was produced as described above for INVENTION EXAMPLE 2 except that BUF01 was added to the overcoating dispersion so that 0.225% of acetic acid and 0.045% of ammonium acetate were additionally present. It was produced as a roll of material 24 cm wide and packed in polyethylene film was tempered for 7 days in a drying cupboard at 45° C., which was not conditioned hence the relative humidity in this cupboard was very low, ca. 10%.

500 sheets of the resulting thermographic recording material were fed at a speed of 4 mm/s onto a drum past the thermal printing head mounted in such a way as to contact the substantially non-photosensitive thermographic recording material using a thermal head with a large pinhole in its outermost layer. No surface damage of the prints could be detected and no defective heating element was detected.

INVENTION EXAMPLES 5 to 10

The thermographic recording materials of INVENTION EXAMPLES 5 to 10 were produced as described for INVENTION EXAMPLE 4 except that different buffers were added to the overcoating dispersion, as indicated in table, and the thermographic recording materials were hardened for 7 days at 45° C. in a relative humidity of 70% instead of for 7 days in a drying cupboard at 45° C., which was not conditioned.

Water absorption measurements were carried out on the resulting thermographic recording materials as follows:

1)strips of the thermographic recording materials of INVENTION EXAMPLES 5 to 10 with a surface area on the side of the thermosensitive element of A square meters were conditioned at 22° C. and 50% relative humidity for 12 hours;

2)then the strips were submerged in deionized water;

3)after the strips were taken out of the water, any surface water was sucked off the strip and the strips were weighed giving the values $M_{wet}$ in g;

4)finally the strips were dried in a forced air drying cupboard for 1 hour at room temperature and the strips again weighed giving the values $M_{dry}$ in g; and 5)the water absorption calculated using the expression:

$$\text{water absorption in g/m}^2=(M_{wet}-M_{dry})/A$$

The results are summarized in table 2.

Thermographic printing of the thermographic recording materials of INVENTION EXAMPLES 5 to 10 was then carried out as described for COMPARATIVE EXAMPLE 3 and INVENTION EXAMPLES 2 & 3 and the results are also summarized in table 2.

TABLE 2

| Invention example number | Colloidal silica* Type | Colloidal silica* conc. in coating dispersion | Dispersant | Buffer used | Water absorption [% by wt.] | Transport in printer | Surface damage |
|---|---|---|---|---|---|---|---|
| 5 | $NH_4^+$ | 1.2% | 01 | BUF01 | 0.94 | excellent | negligible |
| 6 | $NH_4^+$ | 1.2% | 01 | BUF02 | 1.17 | excellent | negligible |
| 7 | $NH_4^+$ | 1.2% | 01 | BUF03 | 0.79 | excellent | negligible |
| 8 | $NH_4^+$ | 1.2% | 01 | BUF04 | 1.02 | excellent | negligible |
| 9 | $NH_4^+$ | 1.2% | 01 | BUF05 | 1.1 | excellent | negligible |
| 10 | $NH_4^+$ | 1.2% | 01 | BUF06 | 1.02 | excellent | negligible |

*prepared as in invention example 1

The low water absorption values for the thermographic recording materials of INVENTION EXAMPLES 5 to 10 indicate that a high degree of hardening of the protective layers has been attained by using the preferred embodiment of the process for producing a thermographic recording material in which the coating composition further contains a buffer with a pH between 2 and 7 consisting of at least one acid and at least one non-metallic salt of an acid. Furthermore, this high degree of protective layer hardening is associated with excellent transport of the thermographic recording materials and negligible surface damage to the protective layers thereof. From these results it is clear that the use of a coating composition, for the outermost layer on the heat-sensitive side of a thermographic recording material, containing colloidal silica in which any acidic groups upon acidification are substantially neutralized with ammonium ions, a hydrophilic polymer having active hydrogen atoms and curing agents selected from the group consisting of polyisocyanates, aldehydes, titanates, zirconates, sulfone, boric acid and hydrolyzed tetraalkyl orthosilicate consisting of polyisocyanates, aldehydes, titanates, zirconates, sulfone, boric acid and hydrolyzed tetraalkyl orthosilicate together with a buffer with a pH between 2 and 7 consisting of at least one acid and at least one non-metallic salt of an acid produces thermographic recording materials in which the image-forming layer is protected and thermal head corrosion is substantially reduced.

COMPARATIVE EXAMPLE 4 and INVENTION EXAMPLE 11

Sodium Concentration in Outermost Layer

The outermost layers of COMPARATIVE EXAMPLE 2 and INVENTION EXAMPLE 3 were coated onto an unsubbed polyethylene support having a thickness of 175um as described in COMPARATIVE EXAMPLE 2 to produce the materials of COMPARATIVE EXAMPLE 4 and INVENTION EXAMPLE 11. 200 $cm^2$ of each of these materials was then extracted with 25 mL of deionized water. The extract with washings with deionized water was then made up to 50 mL in a graduated flask and the sodium ion concentration determined using ionic chromatography (IPC). A control experiment with the support itself showed that the sodium concentration therein was below the detection limit of the method used. The sodium ion concentrations determined for the materials of COMPARATIVE EXAMPLE 4 and INVENTION EXAMPLE 11, corresponding to an outermost layers for which no measures had been taken to reduce the sodium ion concentration therein and an outermost layer for which measures had been taken to reduce the sodium ion concentration were found to be 3500 ppm and less than 280 ppm, the detection limit for sodium ions in the solution resulting from the extraction process using ionic chromatography, respectively, showing the effectiveness of the measures taken to remove sodium ions.

Having described in detail preferred embodiments of the current invention, it will now be apparent to those skilled in the art that numerous modifications can be made therein without departing from the scope of the invention as defined in the following claims.

We claim:

1. A process for producing a thermographic recording material including on one side of a support, called the heat-sensitive side, a thermosensitive element, the outermost layer on the heat-sensitive side containing a cured polymer or cured polymer composition and silica, comprising the steps of: providing the heat-sensitive side of the support with an outermost layer by coating with a composition produced by mixing ingredients including colloidal silica, a curable polymer and a curing agent therefor; and drying and curing the outermost layer, wherein any acidic groups present in said colloidal silica upon acidification are substantially neutralized with ammonium ions, said curable polymer is a hydrophilic polymer having active hydrogen atoms and said curing agent is selected from the group consisting of polyisocyanates, aldehydes, titanates, zirconates, sulfone, boric acid and hydrolyzed tetraalkyl orthosilicate.

2. Production process according to claim 1, wherein said coating composition further contains a buffer with a pH between 2 and 7 consisting of at least one acid and at least one non-metallic salt of an acid.

3. Production process according to claim 1, wherein said buffer with a pH between 2 and 7 is an ammonium acetate/acetic acid buffer.

4. Production process according to claim 1, wherein said curing agent is selected from the group consisting of formaldehyde, glyoxal, glutardialdehyde and hydrolyzed tetramethyl orthosilicate.

5. Production process according to claim 1, wherein said hydrophilic polymer having active hydrogen atoms is polyvinylalcohol.

6. Production process according to claim 1, wherein said colloidal silica has a specific surface area greater than 200 $m^2/g$.

7. Production process according to claim 1, wherein said thermosensitive element contains a substantially light-insensitive organic silver salt in thermally working relationship with an organic reducing agent.

8. Production process according to claim 1, wherein said thermographic recording material is substantially light-insensitive.

9. A method of recording an image comprising the steps of: providing a thermographic recording material including on one side of a support, called the heat-sensitive side, a thermosensitive element, the outermost layer on the heat-sensitive side containing a cured polymer or cured polymer composition and silica, produced by a process comprising the steps of: providing the heat-sensitive side of the support with an outermost layer by coating with a composition produced by mixing ingredients including colloidal silica, a curable polymer and a curing agent therefor; and drying and curing the outermost layer; image-wise heating said thermographic recording material by means of a thermal head contacting said heat-sensitive side of the thermographic recording material; and removing said thermographic recording material from said thermal head, wherein any acidic groups present in said colloidal silica upon acidification are substantially neutralized with ammonium ions, said curable polymer is a hydrophilic polymer having active hydrogen atoms and said curing agent is selected from the group consisting of polyisocyanates, aldehydes, titanates, zirconates, sulfone, boric acid and hydrolyzed tetraalkyl orthosilicate.

10. Method of recording an image according to claim 9, wherein said thermal head is a thin film thermal head.

* * * * *

UNITED STATES PATENT AND TRADEMARK OFFICE

CERTIFICATE OF CORRECTION

PATENT NO. : 6,051,530
DATED : April 18, 2000
INVENTOR(S) : Defieuw et al.

It is certified that error appears in the above-identified patent and that said Letters Patent is hereby corrected as shown below:

Column 17,
Line 12,: "claim 1," should read -- claim 2, --.

Signed and Sealed this

Twelfth Day of June, 2001

Nicholas P. Godici

*Attest:*

*Attesting Officer*

NICHOLAS P. GODICI
*Acting Director of the United States Patent and Trademark Office*